US010434564B2

(12) United States Patent
Kang et al.

(10) Patent No.: US 10,434,564 B2
(45) Date of Patent: Oct. 8, 2019

(54) METHOD FOR MANUFACTURING THREE-DIMENSIONAL LATTICE TRUSS STRUCTURE USING FLEXIBLE LINEAR BODIES

(71) Applicant: INDUSTRY FOUNDATION OF CHONNAM NATIONAL UNIVERSITY, Gwangju (KR)

(72) Inventors: Ki Ju Kang, Jeollanam-do (KR); Hyun Ji Choi, Yeosu-si (KR); Seung Cheul Han, Gwangju (KR); Hara Kim, Wonju-si (KR)

(73) Assignee: INDUSTRY FOUNDATION OF CHONNAM NATIONAL UNIVERSITY, Gwangju (KR)

( * ) Notice: Subject to any disclaimer, the term of this patent is extended or adjusted under 35 U.S.C. 154(b) by 544 days.

(21) Appl. No.: 15/123,780

(22) PCT Filed: Jun. 17, 2014

(86) PCT No.: PCT/KR2014/005315
§ 371 (c)(1),
(2) Date: Sep. 6, 2016

(87) PCT Pub. No.: WO2015/133683
PCT Pub. Date: Sep. 11, 2015

(65) Prior Publication Data

US 2017/0014895 A1 Jan. 19, 2017

(30) Foreign Application Priority Data

Mar. 7, 2014 (KR) ..... 10-2014-0027369

(51) Int. Cl.
*B21F 27/12* (2006.01)
*B21F 27/02* (2006.01)
*B21F 27/14* (2006.01)

(52) U.S. Cl.
CPC ..... *B21F 27/128* (2013.01); *B21F 27/02* (2013.01); *B21F 27/14* (2013.01)

(58) Field of Classification Search
CPC ..... B21F 27/00; B21F 27/005; B21F 27/02; B21F 27/14; B21F 27/128
See application file for complete search history.

(56) References Cited

U.S. PATENT DOCUMENTS 2,986,241 A 5/1961 Fuller
3,955,602 A * 5/1976 King ..... D03D 41/00 139/11

(Continued)

FOREIGN PATENT DOCUMENTS

KR 10-0708483 B1 4/2007
KR 10-2009-0092152 A 8/2009

(Continued)

OTHER PUBLICATIONS

Choi, Ji-Eun, et al., Optimal Design of an Wire-woven Bulk Kagome using taguchi method, 2008 Fall Conference of The Korean Society of Mechanical Engineers, 2008, pp. 13-19.
Sypeck, David J. "Cellular truss core sandwich structures", Applied Composite Materials, 2005, pp. 229-246.

(Continued)

*Primary Examiner* — Teresa M Ekiert
(74) *Attorney, Agent, or Firm* — Paratus Law Group, PLLC

(57) ABSTRACT

A method for manufacturing a three-dimensional lattice truss structure using flexible wires, including: arranging a plurality of out-of-plane wires; forming crossing portions between the plurality of out-of-plane wires; inserting a plurality of in-plane wires in the crossing portions; translating the plurality of in-plane wires in the z-direction; and inserting boundary rods in the y- or x-direction inside the plurality of out-of-plane wire groups.

6 Claims, 16 Drawing Sheets

(56) References Cited

U.S. PATENT DOCUMENTS

| | | | | |
|---|---|---|---|---|
| 4,336,296 | A * | 6/1982 | Fukuta | B29C 70/24 139/383 B |
| 5,228,481 | A | 7/1993 | Kimbara et al. | |
| 8,042,312 | B2 | 10/2011 | Kang et al. | |
| 8,418,730 | B2 * | 4/2013 | Kang | B21F 3/02 140/3 R |

FOREIGN PATENT DOCUMENTS

| | | | |
|---|---|---|---|
| KR | 10-0944326 | B1 | 3/2010 |
| KR | 10-2011-0023453 | A | 3/2011 |
| KR | 10-1029183 | B1 | 4/2011 |
| KR | 10-1114153 | B1 | 2/2012 |
| KR | 10-1155267 | B1 | 6/2012 |

OTHER PUBLICATIONS

S. Hyun, et al., "Simulated properties of Kagome and tetragonal truss core panels", Int. J. of Solids and Structures, 2003, pp. 6989-6998, vol. 40.

S. Chiras, et al., "The structural performance of near-optimized truss core panels", Int. J. of Solids and Structures, 2002, pp. 4093-4115, vol. 39.

D.J. Sypeck and H. N. G. Wadley, "Cellular Metal Truss Core Sandwich Structures", Advanced Engineering Materials, 2002, pp. 759-764, vol. 4.

D.J. Sypeck and H. N. G. Wadley, "Multifunctional microtruss laminates: Textile synthesis and properties", Journal of Materials Research, 2001, pp. 890-897, vol. 16.

International Search Report for PCT/KR2014/005315 dated Dec. 15, 2014 from Korean Intellectual Property Office.

* cited by examiner

-Related Art-

-Related Art-

-Related Art-

-Related Art-

METHOD FOR MANUFACTURING THREE-DIMENSIONAL LATTICE TRUSS STRUCTURE USING FLEXIBLE LINEAR BODIES

CROSS REFERENCE TO PRIOR APPLICATIONS

This application is a National Stage Patent Application of PCT International Patent Application No. PCT/KR2014/005315 (filed on Jun. 17, 2014) under 35 U.S.C. § 371, which claims priority to Korean Patent Application No. 10-2014-0027369 (filed on Mar. 7, 2014), which are all hereby incorporated by reference in their entirety.

TECHNICAL FIELD

The present invention relates to a method for manufacturing a three-dimensional lattice truss structure, and more particularly, to a method for manufacturing a three-dimensional lattice truss structure using flexible wires.

BACKGROUND ART

Typically, metal foams have been mainly used as a light structural material, but recently, open-type light structural bodies having periodic truss structure are being developed as materials replacing such metal foams. Such open-type light structural bodies are configured from truss structures which are designed to have optimal strength and stiffness through an accurate mathematical/mechanical calculation, and thus have superior mechanical properties.

As such a truss structure, an octet truss (R. Buckminster Fuller, 1961, U.S. Pat. No. 2,986,241) having a shape in which regular tetrahedrons and regular octahedrons are combined is the most common. The octet truss is superior in strength and stiffness because constituents of the truss each form regular triangles with each other.

Also, recently, a Kagome truss structure which modifies the octet truss is known (S. Hyun, A. M. Karlsson, S. Torquato, A. G. Evans, 2003, Int. J. of Solids and Structures, Vol. 40, pp. 6989~6998).

In this case, a truss is configured from long thin members having the same cross-sectional area. When all the constituent members of the truss have the same length, the lengths of the truss elements configuring the Kagome truss are merely a half of those of the truss elements configuring the octet truss, and thus buckling which is a main cause of fracture of the truss may be more effectively prevented, and even when buckling occurs, a collapsing process of the truss is much stable. For reference, FIG. 1 illustrates such a three-dimensional Kagome truss structure.

Also, as methods for manufacturing a truss-like porous lightweight structure, following methods are known.

For example, a manufacturing method (S. Chiras, D. R. Mumm, N. Wicks, A. G. Evans, J. W. Hutchinson, K. Dharmasena, H. N. G. Wadley, S. Fichter, 2002, International Journal of Solids and Structures, Vol. 39, pp. 4093~4115) in which a truss structure is formed of a resin, and then a metal is cast using the truss structure as a mold. This method requires high costs due to a complex manufacturing process, and is capable of manufacturing only in case of metals having superior castability, and therefore, the application scope thereof is narrow and the resultant thereof is likely to have many defects in cast structure characteristics and lack in strength.

As another example, a method (D. J. Sypeck and H. N. G. Wadley, 2002, Advanced Engineering Materials, Vol. 4, pp. 759~764), in which holes are periodically formed on a thin metal plate to make the plate in a net shape, a truss intermediate layer is then formed by bending the net-shaped plate, and then face plates are respectively attached to upper and lower portions of the layer, is known. In this method, when wanting to make a multilayered structure having two or more layers, a method, in which the truss intermediate layer made by bending as described above is attached on an upper face plate, and then another face plate is attached again on the face plate, is used. This method has limitations in bonding costs and strength because much material loss is caused during forming holes in the thin metal plate and the number of bonding portions excessively increase when the truss intermediate layer is formed in a multilayer.

As still another example, a method (D. J. Sypeck and H. G. N. Wadley, 2001, J. Mater. Res., Vol. 16, pp. 890~897), in which a net-like mesh is woven by two wires having directions perpendicular to each other and then the mesh is laminated and bonded. This method also has limitations in bonding costs and strength since the mechanical strength of the truss is decreased because the truss basically does not have an ideal structure such as a regular tetrahedron or a pyramid and since the number of bonding portions is excessively increased because nets are laminated to be bonded to each other.

As an example in which the limitations of the above-described prior arts are addressed, Korean Patent No. 0708483 discloses a method for manufacturing a three-dimensional porous lightweight structure having a form similar to an ideal Kagome or octet truss by making continuous wire groups cross each other in six directions, the wire groups having azimuth angle of approximately 60 degrees or 120 degrees in a space (See FIG. 2), and Korean Patent No. 1029183 discloses a method for manufacturing a three-dimensional porous lightweight structure, as a method capable of more effectively manufacturing such three-dimensional lightweight porous structure, in which a continuous wire is previously formed in a spiral shape, and then the formed spiral wire is inserted into a plurality of woven body spaced apart a predetermined interval from each other while being rotated.

Also, Korean Patent No. 0944326 discloses a method for manufacturing a structure having a similar form to a three-dimensional Kagome truss by using flexible liner bodies, and Korean Patent No. 1114153 discloses a method capable of weaving a structure having a similar form to the three-dimensional Kagome truss which is configured from the above-mentioned flexible liner bodies or stiff spiral wires.

The above-mentioned Korean Patent No. 0708483, Korean Patent No. 1029183, Korean Patent No. 0944326, and Korean Patent No. 1114153 have something in common in that all disclose a method for manufacturing a three-dimensional porous lightweight structure by inserting flexible wires and spiral wires in three out-of-plane directions in a state in which objects similar to a two-dimensional Kagome truss are made in advance and are disposed at regular intervals.

FIG. 3 illustrates a perspective view and a plan view of a three-dimensional lattice truss structure similar to a three-dimensional Kagome truss structure woven by such a method, and FIG. 4 illustrates a unit cell of the structure of FIG. 3.

Referring to FIG. 4, there is a problem in that it is practically difficult to simultaneously cross and assemble in-plane wires 1, 2 and 6 in three directions and out-of-plane wires 3, 4 and 5 in the three directions, and it is difficult to realize a three-dimensional lattice truss structure through a continuous process because there is a limitation in that an object similar to a two-dimensional Kagome truss should be formed in a plane, that is in an xy plane. Also, when a three-dimensional porous lightweight structure having a rectangular parallelepiped shape is manufactured through such a method, there is a problem in that the appearance of the structure deteriorates, and the mechanical strength of the structure also deteriorates because the shape of the periphery of the structure is not uniform for each layer as illustrated in FIG. 3.

DISCLOSURE OF THE INVENTION

Technical Problem

The purpose of the present invention is to provide a method for manufacturing a three-dimensional lattice truss structure by simultaneously weaving flexible wires through a continuous process in an in-plane direction and an out-of-plane direction.

Technical Solution

Technical solutions of the present invention to the above-mentioned technical problems are as follows.

(1) A method for manufacturing a three-dimensional lattice truss structure using flexible wires including a plurality of out-of-plane wires and a plurality of in-plane wires, the method including the steps of: (a) arranging the plurality of out-of-plane wires such that at least any one end forms a free end which is movable in x- and y-directions on an xy plane, and the other end forms a fixed end which is restrained from moving in the x- and y-directions on the xy plane in a state in which the plurality of out-of-plane wires are spaced apart from each other at a predetermined interval (Dxy); (b) forming crossing portions between the plurality of out-of-plane wires by switching the free ends of adjacent out-of-plane wire groups, among a plurality of out-of-plane wire groups selected in the y- or x-direction, in the x- or y-direction on the xy plane; (c) inserting the plurality of in-plane wires in the y- or x-direction in the crossing portions in a state in which the free ends of a plurality of out-of-plane wire groups, among a plurality of out-of-plane wire groups selected in the x- or y-direction, are integrally moved to cross each other in the x- or y-direction; (d) translating the plurality of in-plane wires in the z-direction in a state in which the free ends of the plurality of out-of-plane wires which were moved to cross each other in step (c) are returned to the original positions thereof; and (e) inserting boundary rods in the y- or x-direction inside the plurality of out-of-plane wire groups which are selected from the y- or x-direction but not switched in step (b), wherein orientations are defined on the basis of an x, y and z orthogonal coordinates system, a cycle of steps (b) to (e) is repeatedly performed, and the plurality of in-plane wires are arranged in the z-direction to be spaced apart from each other at a predetermined interval (Dz).

(2) In said step (b), a direction in which the plurality of out-of-plane wire groups are selected may be perpendicular to a direction in which the free ends are switched.

(3) In said step (c), a direction in which the plurality of out-of-plane wire groups to be moved to cross each other are selected and a direction in which the plurality of in-plane wires are inserted may be the same as the direction in which the free ends of the plurality of out-of-plane wire groups are switched, and the direction in which the plurality of in-plane wires are inserted in said step (b) may be perpendicular to the direction in which the free ends of the plurality of out-of-plane wire groups are switched in said step (b).

(4) in said step (e), the direction in which the plurality of out-of-plane wire groups are selected and the direction in which the boundary rods are inserted may be perpendicular to the direction in which the free ends of the plurality of out-of-plane wire groups are switched in said step (b).

(5) In said step (b), the direction in which the plurality of out-of-plane wire groups are selected may be alternately determined in the y- or x-direction for every cycle, and a process in which the plurality of out-of-plane wire groups are switched may be performed by a unit group comprising two cycles such that: the switching is performed from an outermost out-of-plane wire group in a first cycle group and is performed from a next out-of-plane wire group excluding the outermost group in a second cycle group, and the first and second cycle groups are alternately performed.

(6) An odd number of the plurality of out-of-plane wire groups may be formed in the x- and y-directions.

(7) The boundary rods may be inserted for every cycle.

(8) An even number of the plurality of out-of-plane wire groups may be formed in the x- and y-directions.

(9) The boundary rods may be inserted for every two cycles.

(10) An interval (Dz) at which the plurality of in-plane wires are spaced apart from each other in the z-direction may be approximately $\sqrt{2}/2$ times the interval (Dxy) at which the plurality of out-of-plane wires are spaced apart from each other in the x- and y-directions on the xy plane.

(11) In said step (a), the plurality of out-of-plane wires may be arranged in parallel in the z-direction.

(12) In said step (a), a spaced interval at the free ends of the plurality of out-of-plane wires may be greater than the spaced interval (Dxy) at fixed ends of the out-of-plane wires.

Advantageous Effects

A method for manufacturing a three-dimensional lattice truss structure according to the present invention has a simple process and is advantageous to mass production because flexible wires are simultaneously and continuously woven in in-plane directions and in out-of-plane directions.

Also, the three-dimensional lattice truss structure manufactured according to the above-mentioned manufacturing method has a prismatic shape and has a uniform boundary, thereby having superior appearance design and mechanical strength.

MODE FOR CARRYING OUT THE INVENTION

Figure 1:
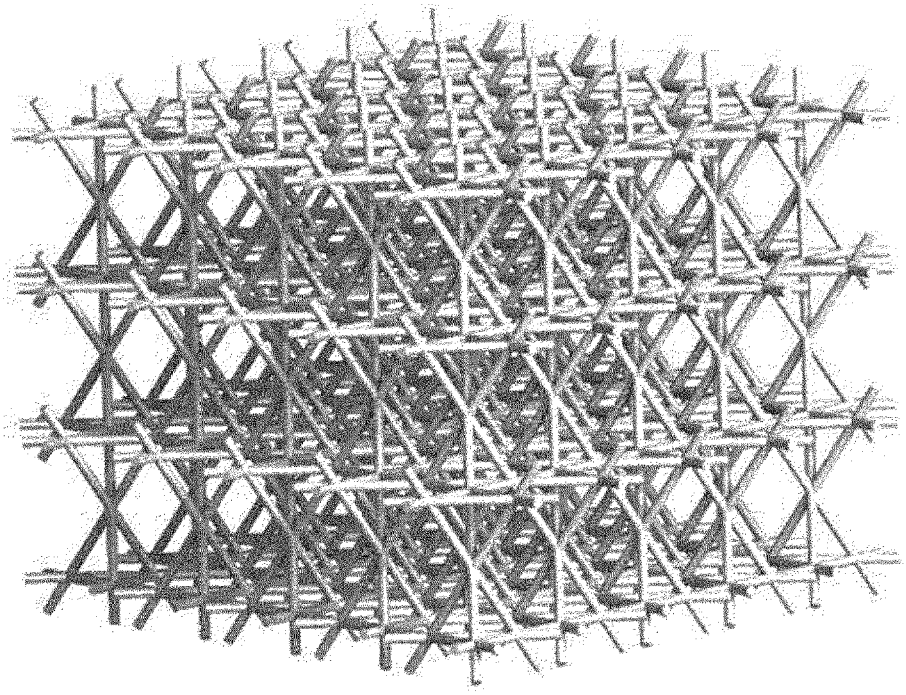
FIG. 1 illustrates a three-dimensional Kagome truss structure.
Figure 2:
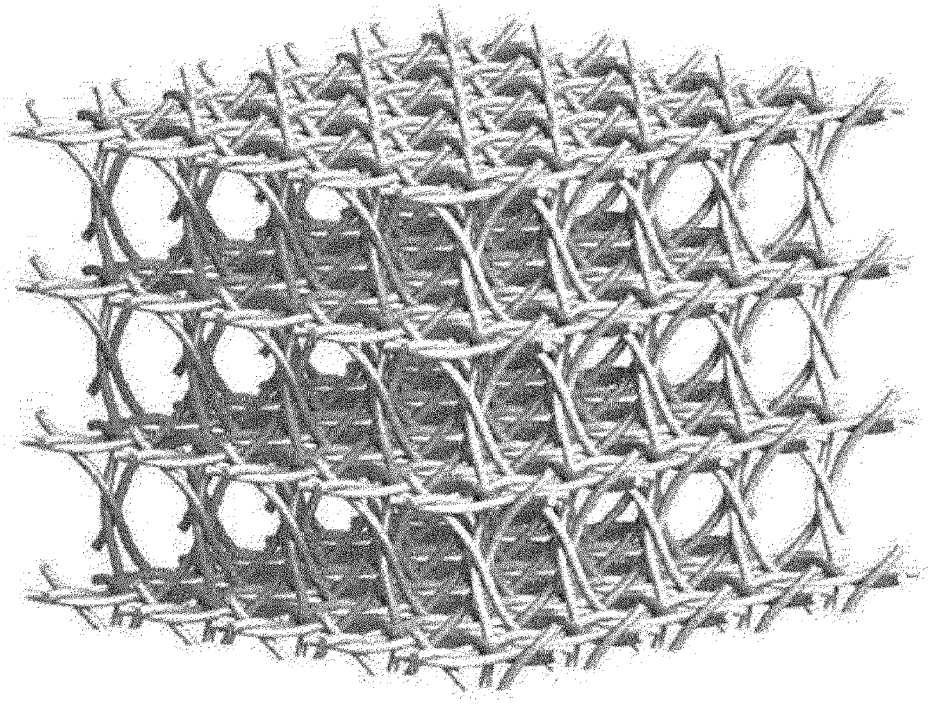
FIG. 2 illustrates a three-dimensional porous lightweight structure according to a related art similar to a three-dimensional Kagome truss structure.

Exemplary embodiments of the present invention will now be described in detail with reference to the accompanying drawings so that those skilled in the art pertaining to the present invention easily implement the embodiment. However, the present invention can be practiced in various ways and is not limited to the embodiments described herein. Also, parts in the drawings unrelated to the detailed description are omitted to ensure clarity of the present invention. Like reference numerals in the drawings denote like elements throughout.

Furthermore, apparatuses exemplified in the embodiments below are exemplified to only describe a manufacturing method according to the present invention, and technical idea of the manufacturing method according to the present invention should not be construed as being limited by components of the apparatuses or operation details.

Also, in the description below, disposition shapes, moving directions, or the like of flexible wires or boundary rods which constitute a three-dimensional lattice truss structure are described on the basis of x, y and z orthogonal coordinates illustrated in the drawings. In this case, an xy plane may be a plane on which in-plane wires are positioned in a three-dimensional lattice truss structure according to the present invention as described below.

Figure 4:
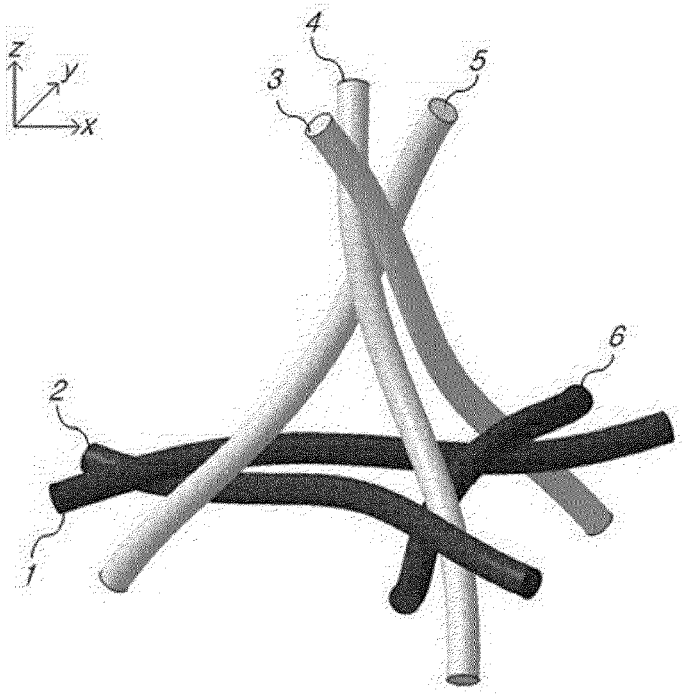
FIG. 4 illustrates a unit cell of the structure of FIG. 3.

Referring to FIG. 4, a unit cell of a typical three-dimensional lattice truss structure similar to a three-dimensional Kagome truss structure is configured from in-plane wires (1,2, and 6 of FIG. 4) in three directions and out-of-plane wires (3, 4, and 5 of FIG. 4) in three directions. In this case, "in-plane liner bodies" means wires positioned on the xy plane, and "out-of-plane wires" means wires positioned in directions passing through the xy plane.

In the unit cell of FIG. 4, since the in-plane wires (1, 2 and 6 of FIG. 4) in three directions cross each other in the same plane, it is practically difficult to simultaneously cross and assemble the in-plane wires (1, 2 and 6 of FIG. 4) in three directions and the out-of-plane wires (3, 4 and 5 of FIG. 4) in three directions, as described above.

Figure 3:
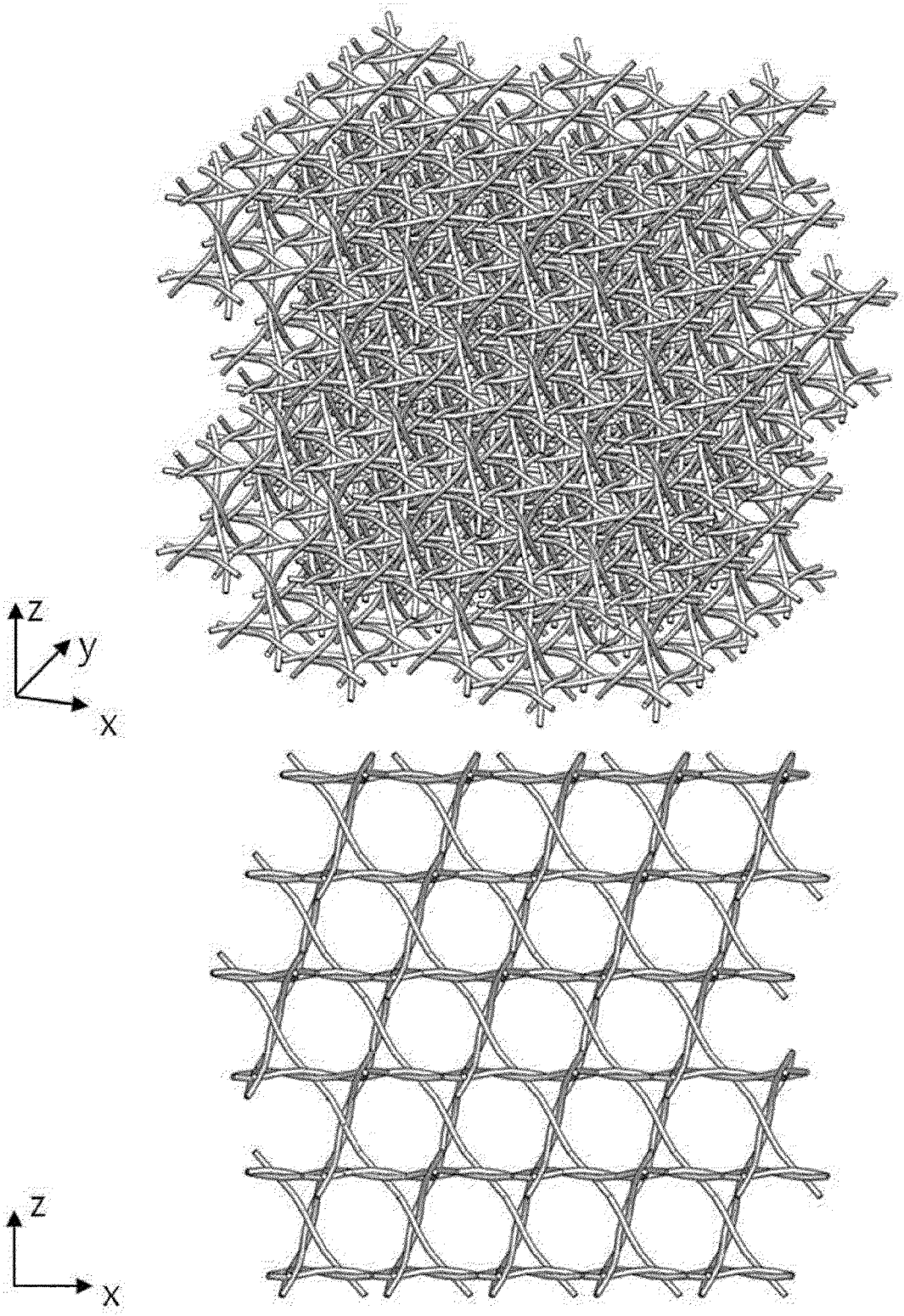
FIG. 3 illustrates a perspective view and a projected figure of a three-dimensional lattice truss structure similar to a three-dimensional Kagome truss structure woven through such a method.
Figure 5:
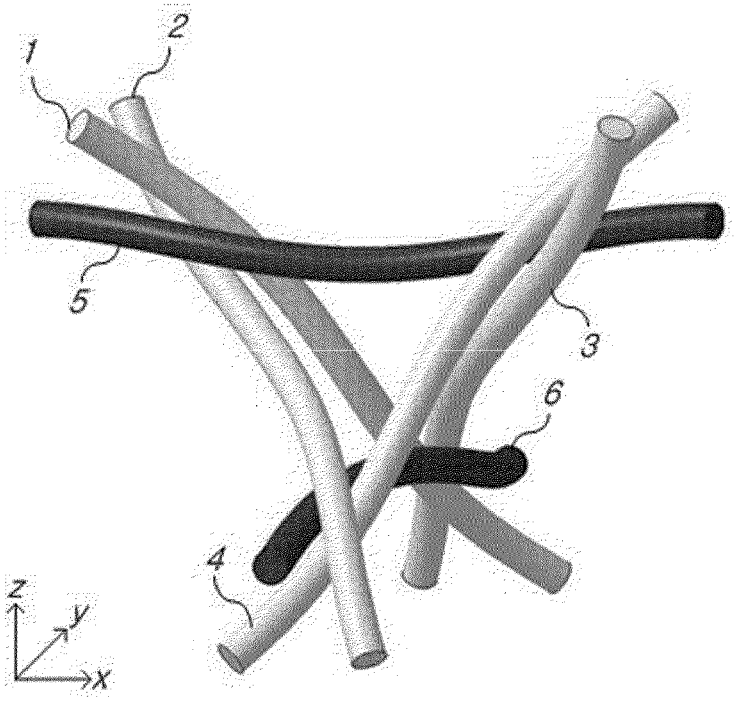
FIG. 5 illustrates a unit cell of a three-dimensional lattice truss structure according to the present invention.

FIG. 5 illustrates a unit cell of a three-dimensional lattice truss structure manufactured according to the present invention. The unit cell according to FIG. 5 a unit cell recognized in a state of being rotated clockwise by approximately degrees around an axis which is any one of in-plane wires constituting the unit cell of FIG. 3, for example, the wire 6 of FIG. 4.

Figure 6:
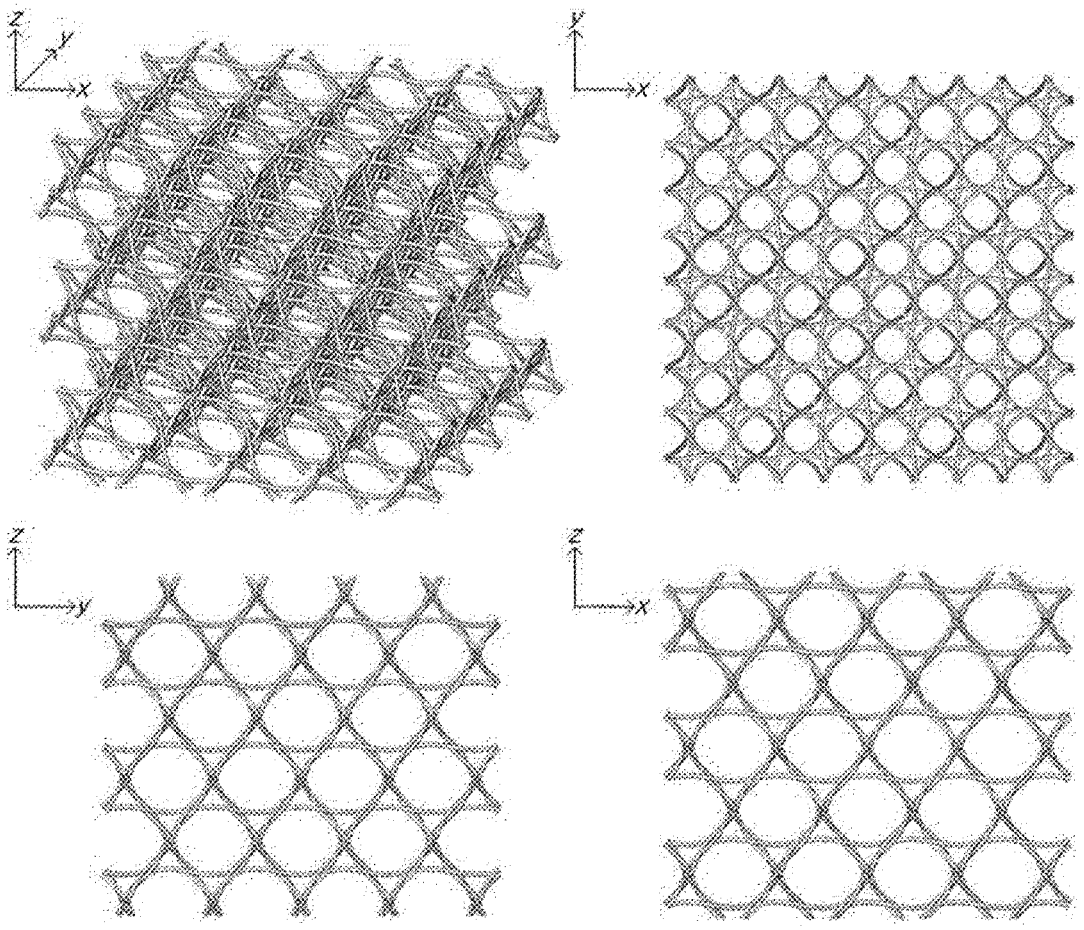
FIG. 6 is a perspective view of a three-dimensional lattice truss structure similar to a three-dimensional Kagome truss structure recognized from the unit cell of FIG. 5 and a projected figure viewed from a specific direction.

In the unit cell according to FIG. 5, there exist in-plane wires (5 and 6 of FIG. 5) in two directions and out-of-plane wires (1, 2, 3, and 4 of FIG. 5) in four directions, the in-plane wires (5 and 6 of FIG. 5) in two directions do not cross on the same plane, and one in-plane wire and two out-of-plane wires cross each other. Since the number of in-plane wires is decreased and do not cross each other in the unit cell having such a shape unlike that in FIG. 4, it is easy to simultaneously assemble and weave the unit cell in an out-of-plane direction and in an in-plane direction by using flexible wires as described below. FIG. 6 is a perspective view of a three-dimensional lattice truss structure similar to a three-dimensional Kagome truss structure recognized from the unit cell of FIG. 5 and a projected figure viewed from a specific direction.

Figure 7:
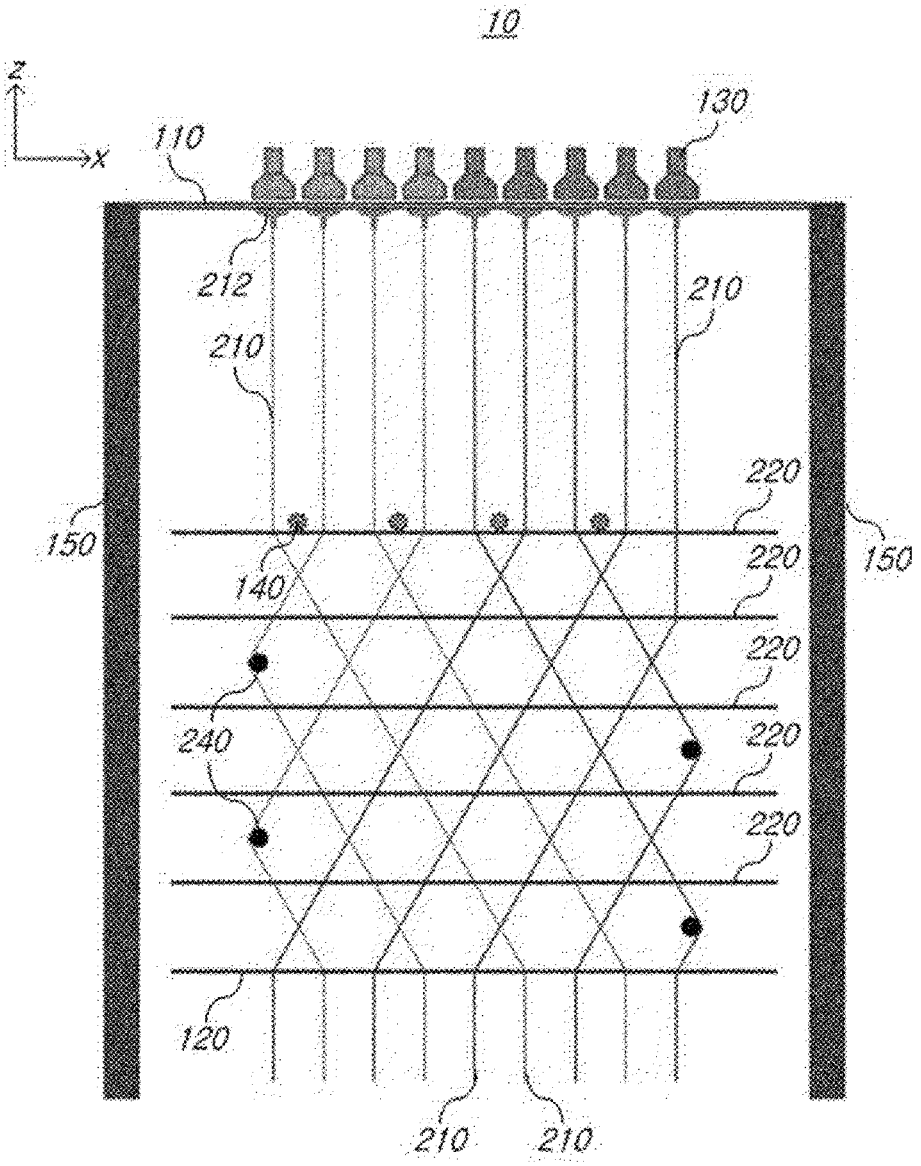
FIG. 7 illustrates a schematic configuration diagram of an apparatus for manufacturing a three-dimensional lattice truss structure according to an embodiment of the present invention.

FIG. 7 illustrates a schematic configuration diagram of an apparatus for manufacturing a three-dimensional lattice truss structure according to an embodiment of the present invention, and the three-dimensional lattice truss structure according to the present invention is illustrated in a partially woven state in FIG. 7. However, as described above, an apparatus 10 according to FIG. 7 is exemplified for convenience of description of a manufacturing method according to the present invention, and fundamental technical idea of the manufacturing method according to the present invention should not be construed as being limited by the configuration or operation details of components 110, 120, and 130 according to the apparatus 10.

The apparatus 10 according to FIG. 7 includes a side wall frame 150, an upper stage plate 110, and a lower stage plate 120 which have plate shapes and are respectively fixed to upper and lower stages of the side wall frame 150. Also, the apparatus 10 includes a close contacting rod 140 for downwardly bringing the in-plane wires into close contact with each other. Grips 130 are disposed on the upper stage plate 110 to fixedly support one ends of the out-of-plane bodies 210, and for example, hole portions (not shown) is formed on the lower stage plate 120 so as to support the other ends of the out-of-plane wires 210 at a predetermined position.

In this case, a shape in which one ends of the out-of-plane wires 210 are fixed by the grips 130 may be a method in which the grips 130 are configured from, for example, magnetic blocks, the upper stage plate 110 is selected to be formed of a material such as a transparent acryl plate through which magnetism can pass, and the metal blocks 212 and the grips 130 are pulled to each other by magnetic force with the upper stage plate 110 therebetween in a state in which the metal blocks 212 are attached to the one ends of the out-of-plane wires 210. In this case, the end portions of the out-of-plane wires 210 which are fixedly supported by the grips are recognized as free ends which are movable in x- or y-direction on an xy plane, that is, on the upper surface of the upper stage plate 110. Also, in the manufacturing method described below, a process in which one ends of the out-of-plane wires 210 adjacent to each other are switched on the xy plane or a process in which out-of-plane wire groups 210 selected in y- or x-direction are moved to cross each other or returned to original positions on the xy plane, may be understood as the grips 130 positionally corresponding to the end part of the out-of-plane wires 210 are moved on the xy plane on the upper stage plate 110.

Also, the out-of-plane wires 210 supported by the lower stage plate 120 have the other ends which are maintained according to the position of forming hole portions on the xy plane but are assumed to pass through the hole portions to be slidable in the z-direction. These sliding process may be understood such that in a process in which one ends of the out-of-plane wires 210 adjacent to each other are switched on the xy plane, or in a process in which out-of-plane wire groups 210 selected in the x- or y-direction are moved to cross each other or returned to original positions, the out-of-plane wires 210 are movable, in the z-direction, into and out of a region in which a lattice truss structure is woven, that is, a region between the upper stage plate 110 and the lower stage plate 120.

Figure 8:
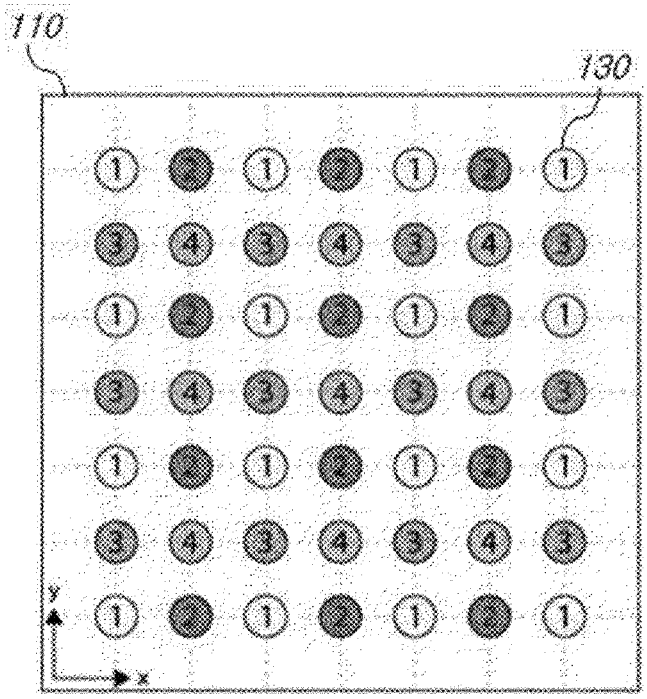
FIG. 8 illustrates a plan view of the apparatus according to FIG. 7.

FIG. 8 illustrates a plan view of the apparatus according to FIG. 7, and specifically, illustrates a shape in which the grips 130 are disposed on the upper surface of the upper stage plate 110 of the apparatus 10. The grips 130 form a matrix in x- and y-directions and are regularly disposed on the upper stage plate 110, that is, on the xy plane. The grips 130 positionally corresponds to the end portions of the out-of-plane wires (210 of FIG. 7), and according to orientations of the out-of-plane wires (210 of FIG. 7), are classified into four kinds (1, 2, 3 and 4 of FIG. 8) for convenience of description. This corresponds to the feature in which the out-of-plane wires exist in four directions in FIG. 5.

Figure 9:
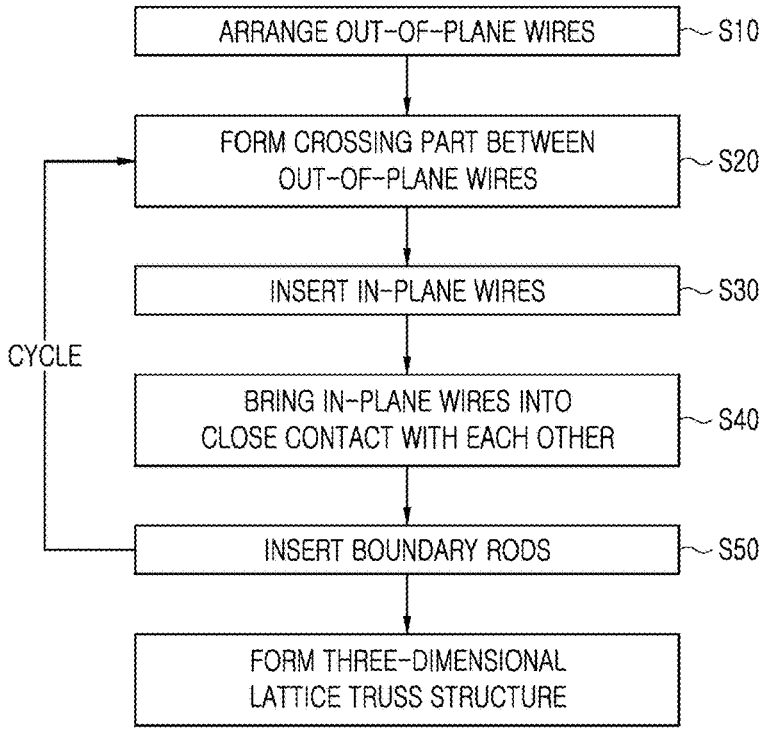
FIG. 9 illustrates a flowchart of a method for manufacturing a three-dimensional lattice truss structure according to the present invention.

FIG. 9 illustrates a flowchart of a method for manufacturing a three-dimensional lattice truss structure according to the present invention. The manufacturing method includes the steps of: arranging a plurality of out-of-plane wires in parallel (S10); forming crossing portions among the out-of-plane wires (S20); inserting in-plane wires on the crossing portions (S30); bringing the in-plane wires into close contact with each other (S40); and inserting boundary rods into outer sides of the out-of-plane wires (S50), wherein said steps S20 to S50 are repeatedly performed several times as one cycle, and the inserted in-plane wires are arranged to be spaced apart a predetermined interval from each other in the vertical direction in step S40.

In this case, the boundary rods are inserted for the purpose of uniformly guiding the outlines of outer surfaces of the three-dimensional lattice truss structure by preventing the out-of-plane wires from being continuously moved in only one direction in the manufacturing process of the three-dimensional lattice truss structure according to the present invention. These boundary rods may be selectively separated from the structure when the manufacturing of the three-dimensional lattice truss structure is completed. Also, the boundary rods are not always inserted for every cycle including steps S20 to S50, and as described below, may be inserted dependent on the number of the out-of-plane wires constituting a matrix in the x- and y-directions on the xy plane.

A basic process flow of the manufacturing method according to the present invention will be described in more detail below.

Figure 10:
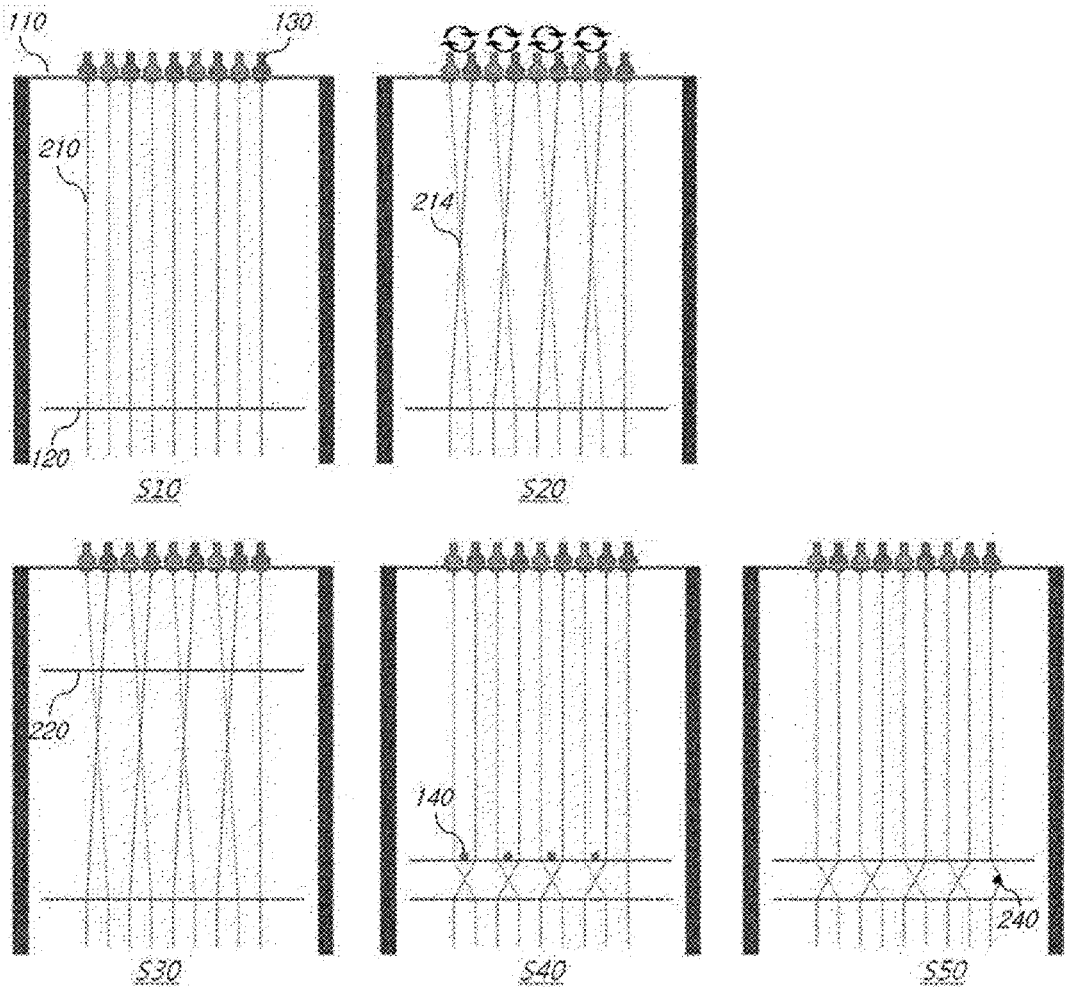
FIG. 10 illustrates a conceptual diagram of a unit process in a manufacturing process for a three-dimensional lattice truss structure according to an embodiment of the present invention.

FIG. 10 illustrates a conceptual diagram of a unit process in a process for manufacturing a three-dimensional lattice truss structure according to an embodiment of the present invention. FIG. 10 is illustrated as a front view of the apparatus 10 according to FIG. 7, and out-of-plane wires are simply illustrated to be inserted only in x-direction and the boundary rods are illustrated to be inserted only in y-direction, due to the limitation in illustration. More specific directions in which the out-of-plane wires and the boundary rods are inserted may be clearly ensured from FIGS. 11 to 14 together with directions in which the out-of-plane wires are switched or moved to cross each other.

Figure 11:
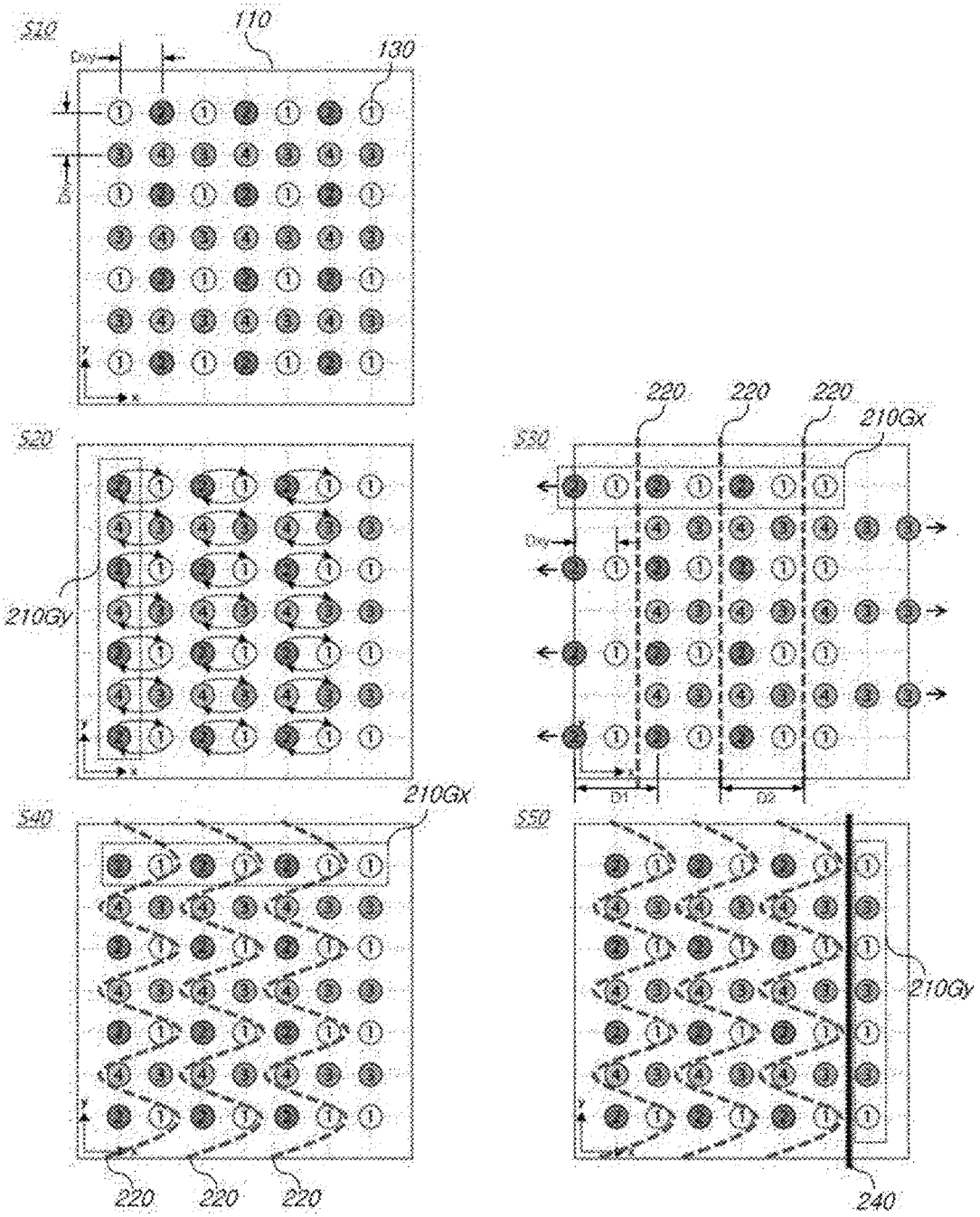
FIGS. 11 to 14 are illustrated as plane views according to FIG. 7 with regard to an embodiment of FIG. 10.

FIG. 11 is illustrated as a plane view of the apparatus according to FIG. 7 with regard to an embodiment of FIG. 10.

As described above, in the description of an embodiment, selecting directions, moving or inserting directions, and disposition shapes of flexible wires 210 and 220 constituting the three-dimensional lattice truss structure or end portions thereof, and inserting directions, disposition shapes, and the like of boundary rods 230 will be described on the basis of x, y, and z orthogonal coordinates illustrated in the drawing. In this case, an xy plane is assumed as a plane on which in-plane wires 220 are positioned in the three-dimensional lattice truss structure according to the present invention.

Also, in the current embodiment, the number of the out-of-plane wires 210 arranged in the x- and y-directions on the xy plane is assumed as an odd number, and is specifically illustrated as 7, but the present invention is not limited thereto.

Firstly, referring to step S10 of FIG. 10 and step S10 of FIG. 11, in the state in which the out-of-plane wires 210 are fixedly supported such that upper ends thereof are inserted into an upper stage plate 110 and lower ends thereof are inserted into hole portions (not shown) of a lower stage plate 120, the out-of-plane wires 210 are arranged in parallel in the z-direction to be spaced apart a predetermined interval Dxy from each other in the x- and y-directions between the upper stage plate 110 and the lower stage plate 120 (S10). A predetermined tensile force is applied to the out-of-plane wires 210.

In this case, grips 130 form a matrix in the x- and y-directions and are regularly disposed in the x- and y-directions on the upper stage plate 110, that is, on the xy plane to be spaced apart a predetermined interval Dxy from each other. End portions of the out-of-plane wires 210 fixedly supported by the grips 130 are recognized as free ends which are movable in the x- or y-direction on the xy plane, that is, on the upper surface of the upper stage plate 110. Also, as described in FIG. 8, the grips 130 positionally correspond to the end portions of the out-of-plane wires 210 and are classified into four kinds (1, 2, 3, and 4 of FIG. 8) according to orientations of the corresponding out-of-plane wires 210, and this corresponds to the feature in which the out-of-plane wires exist in four directions in FIG. 5. In the drawings and descriptions below, the shape in which the end portions of the out-of-plane wires 210 are moved will be described by being represented as a positional change of the grips 130 on the upper stage plate 110.

Next, referring to step S20 of FIG. 10 and step S20 of FIG. 11, with regard to a plurality of out-of-plane wire groups 210Gy selected in the y-direction, upper ends of the out-of-plane wires 210 adjacent to each other are switched in the x-direction on the upper stage plate 110, that is, on the xy plane, and thus crossing portions 214 are formed between the plurality out-of-plane wire group 210 (S20). In this case, the lower ends of the out-of-plane wires 210 are in the state of fixedly supported at original positions on the lower stage plate 120, and the crossing portions 214 are formed in a region between the upper stage plate 110 and the lower stage plate 120. In this case, the direction y in which the plurality of out-of-plane wire groups 210Gy are selected is perpendicular to the direction in which the end portions of the out-of-plane wires 210 are switched in said step S20.

Next, referring to step S30 of FIG. 10 and step S30 of FIG. 11, in a state in which a plurality of out-of-plane wire groups 210Gx selected in the x-direction are moved to cross each other in the x-direction, a plurality of in-plane wires 220 are inserted into the crossing portions 214 in the y-direction (S30). The "moved to cross each other" means that the out-of-plane wire groups 210Gx adjacent to each other are moved in directions opposite to each other. In this case, the direction x in which the plurality of out-of-plane wire groups 210Gx are selected and moved to cross each other is the same as the direction x in which the end portions of the out-of-plane wires 210 are switched in said step S20. The direction y in which the plurality of in-plane wires 220 are inserted and the direction x in which the end portions of the out-of-plane wires 210 are switched in said step S20 are perpendicular to each other. Also, an interval D1 by which the out-of-plane wire groups 210Gx are moved to cross each other and an interval D2 at which the plurality of in-plane wires 220 are inserted are twice as large as the interval Dxy at which the out-of-plane wires are arranged.

Next, referring to step S40 of FIG. 10 and step S40 of FIG. 11, in a state in which the plurality of out-of-plane wire groups 210Gx moved to cross each other in the x-direction are returned to original positions, the plurality of in-plane wires 220 are brought into close contact with each other by being downwardly translated in the z-direction by using close contacting rods 140 (S40). In this case, the upper ends of the plurality of the out-of-plane wires 210 are maintained at the switched state. In step S30 of FIG. 11, the plurality of in-plane wires 220 are illustrated as a shape bent in the x-direction during the process of returning the plurality of out-of-plane wire groups 210Gx to original positions, but are downwardly translated in the z-direction while applying a predetermined tensile force to each of the plurality of in-plane wires 220 and are thus straightened in a straight line shape as approaching the crossing portions 214 (see FIGS. 15 and 16). Before and after said step S40, the close contacting rods 140 are assumed to be moved into or out of a weaving region between the upper stage plate 110 and the lower stage plate 120, and the inserting direction x of the close contacting rods 140 is perpendicular to the inserting direction y of the in-plane wires 220.

Subsequently, referring to step S50 of FIG. 10 and step S50 of FIG. 11, a boundary rod 240 is inserted, in the y-direction, inside the out-of-plane wire groups 210Gy which are not switched in said step S20, that is, inside the out-of-plane wire groups 210Gy which are positioned rightmost side in step S50 of FIG. 11 (S50). The boundary rod 240 is formed of a stiff material and is inserted inside the out-of-plane wire group 210Gy which is not switched because an adjacent out-of-plane wire 210 does not exist in said step S20, thereby preventing the out-of-plane wires from continuously moving in only one direction. In this case, the direction y in which the plurality of out-of-plane wire groups 210Gy are selected and the boundary rod is inserted is perpendicular to the direction x in which the end portions of the out-of-plane wires 210 are switched in said step S20. The boundary rod 240 is parallel to a plane formed by the plurality of in-plane wires 220 brought into close contact each other in said step S40, that is, to the xy plane.

As described above, the method for manufacturing the three-dimensional lattice truss structure according to the present invention includes a process in which said steps S20 to S50 are repeatedly performed several times as one cycle, and in FIGS. 10 and 11 above, an example in which steps S20 to S50 are performed once as one cycle after performing step S10 is illustrated.

Figure 12:
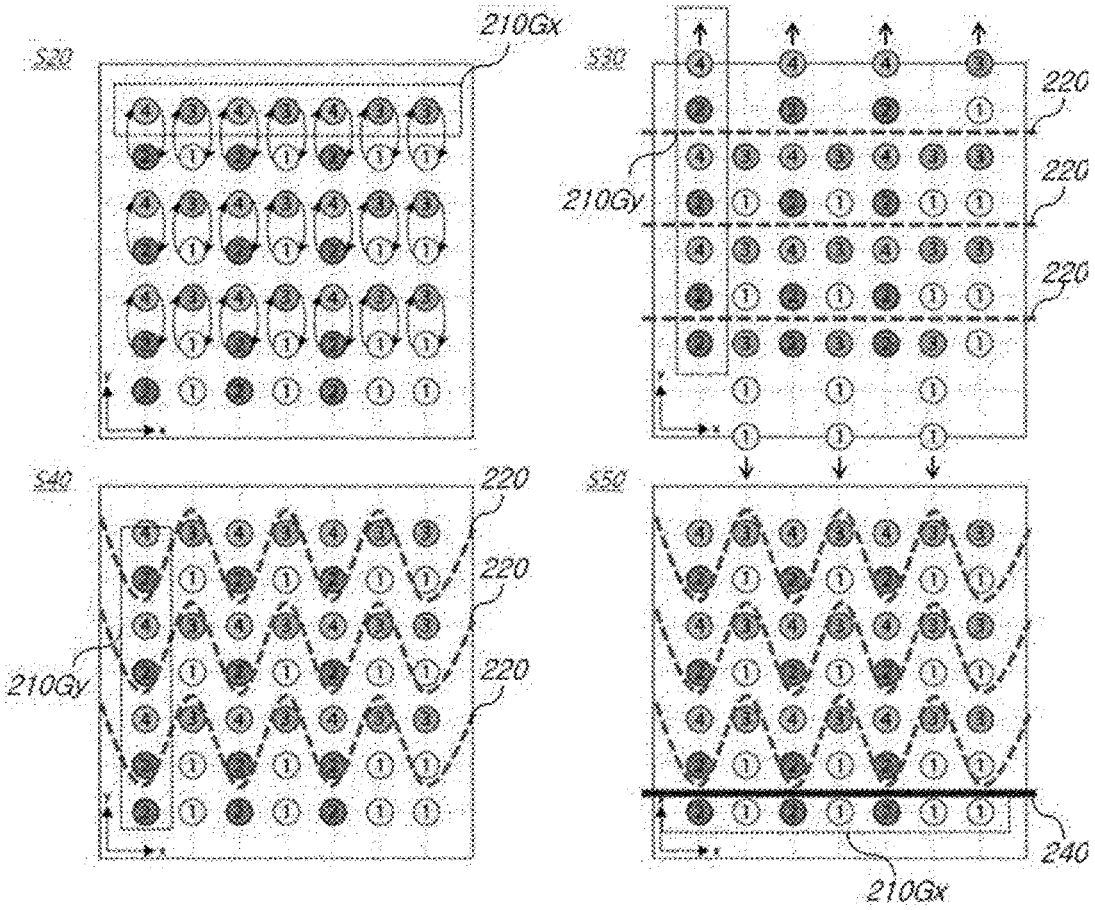
Figure 13:
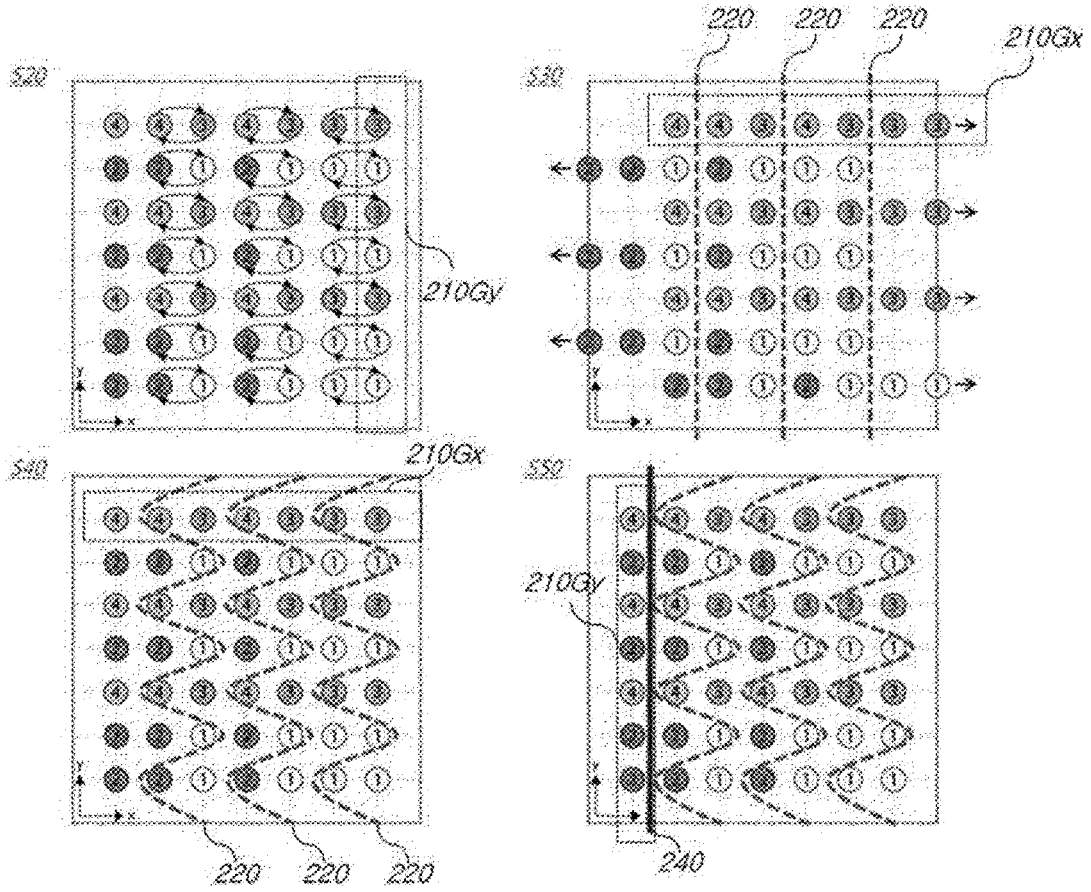
Figure 14:
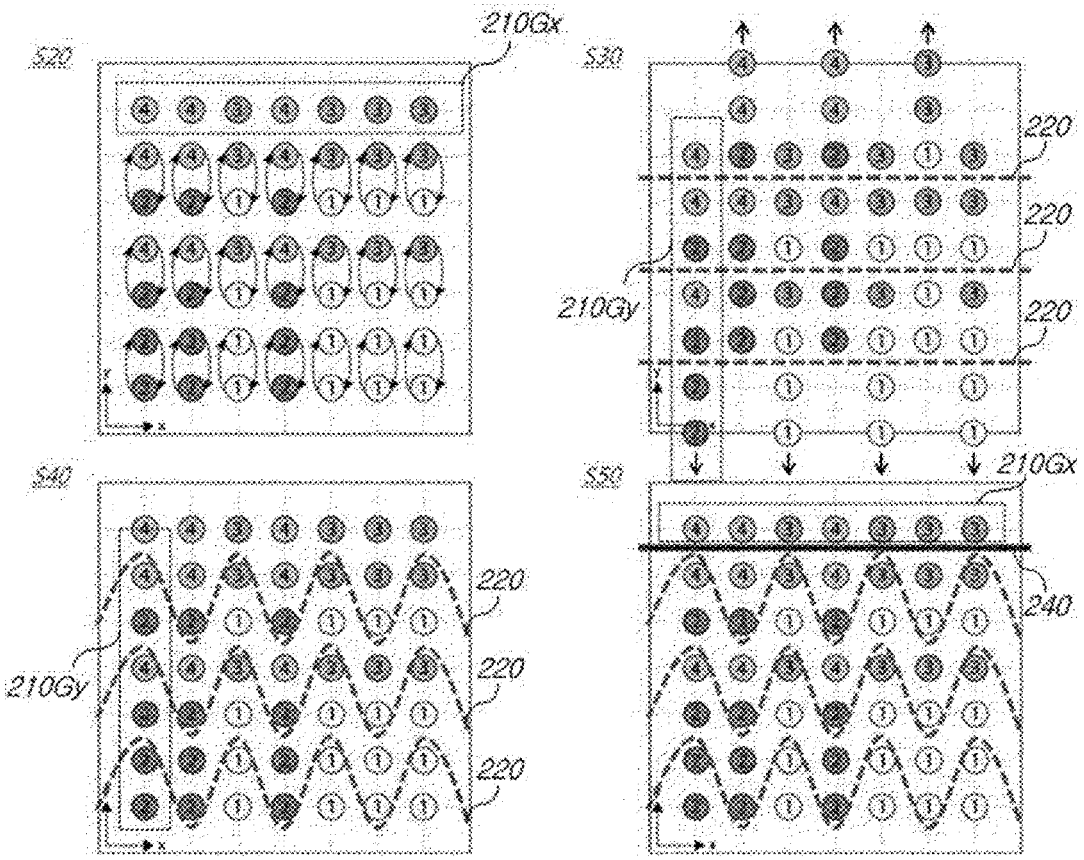

Also, FIGS. 12 to 14 are illustrated, like FIG. 11, as plan views of the apparatus according to FIG. 7 regarding the embodiment of FIG. 10, and a process in which said steps S20 to S50 are sequentially performed two, three and four times as one cycle is illustrated. In FIGS. 12 to 14, some of reference symbols are omitted.

Referring to FIGS. 11 to 14, a direction in which the plurality of out-of-plane wire groups are selected in step S20 of each cycle is the direction opposite to that in the previous cycle, and the direction is alternately selected as the y- or x-direction for each cycle. For example, in FIGS. 11 to 14, the direction is sequentially selected as y-direction, x-direction, y-direction and x-direction. Also, the process of switching the plurality of out-of-plane wire groups is performed in the direction opposite to that in the previous cycle. In the first and second cycles, the switching is performed from the outermost out-of-plane wire group, and in the third and fourth cycles, the switching is performed from the out-of-plane wire group excluding the outermost group. For example, in the first and second cycles, according to FIG. 11, the switching is performed in the x-direction from the leftmost out-of-plane wire group, and according to FIG. 12, the switching is performed in the y-direction from the uppermost out-of-plane wire group. In the third and fourth cycles, according to FIG. 13, the switching is performed in the x-direction from the next group excluding the leftmost out-of-plane wire group, and according to FIG. 14, the switching is performed in the y-direction from the next group excluding the uppermost out-of-plane wire group. In this case, in each cycle, the out-of-plane wire group which are not switched (the rightmost out-of-plane wire group in FIG. 11, the lowermost out-of-plane wire group in FIG. 12, the leftmost out-of-plane wire group in FIG. 13, and the uppermost out-of-plane wire group in FIG. 14) serve as references for inserting the boundary rods inside the group in step S50 in each cycle. A cycle group including the first and second cycles and a cycle group including the third and fourth cycles are alternately performed.

Also, in step S30 of each cycle, the direction in which the out-of-plane wire group to be moved to cross each other is selected and the direction of moving to cross each other are opposite to those in the previous cycle. For example, the direction is sequentially selected as the x-direction, the y-direction, the x-direction, and the y-direction in FIGS. 11 to 14. Also, the direction in which the in-plane wires are inserted is opposite to that in the previous cycle. For example, the direction is sequentially selected as the y-direction, the x-direction, the y-direction, and the x-direction in FIGS. 11 to 14. In this case, the interval by which the out-of-plane wires are moved to cross each other and the interval at which the plurality of in-plane wires are inserted are twice as large as the interval in which the out-of-plane wires are arranged.

Also, in step S40 of each cycle, the direction in which the out-of-plane wire group to be returned to an original position is selected and the direction of returning to the original position are opposite to those in the previous cycle. For example, the direction is sequentially selected as the x-direction, the y-direction, the x-direction, and the y-direction in FIGS. 11 to 14. In this case, the in-plane wires which are newly formed by moving according to each cycle are spaced apart a predetermined interval from each other in the z-direction. The interval Dz (see FIGS. 16 and 18) at which the plurality of in-plane wires are spaced apart from each other in the z-direction may be $\sqrt{2}/2$ times the interval Dxy (see FIGS. 16 and 18) by which the plurality of out-of-plane wires are spaced apart from each other in the x- and y-directions on the xy plane, and accordingly, the manufactured three-dimensional lattice truss structure becomes similar to a three-dimensional Kagome truss structure. Also, before and after step S40 of each cycle, the inserting direction of the close contacting rods is, for example, the x-direction, the y-direction, the x-direction, and y-direction in this order in FIGS. 11 to 14.

Also, the direction in which the boundary rod is inserted is opposite to that in the previous cycle. For example, the direction is the y-direction, the x-direction, the y-direction, and the x-direction in this order in FIGS. 11 to 14. Likewise, the direction of the outermost out-of-plane wire selected to insert the boundary rod is opposite to that in the previous cycle. For example, the direction is sequentially selected as the y-direction, the x-direction, the y-direction, and the x-direction in FIGS. 11 to 14.

In the embodiments of FIGS. 11 to 14, the number of out-of-plane wires arranged in the x- and y-directions on the xy plane is an odd number, and the boundary rods 240 are inserted inside the out-of-plane wires (the rightmost out-of-plane wire group in FIG. 11, the lowermost out-of-plane wire group in FIG. 12, the leftmost out-of-plane wire group in FIG. 13, and the uppermost out-of-plane wire group in FIG. 14) which are not switched in each cycle. Accordingly, in the embodiment, the boundary rods are illustrated to be sequentially inserted clockwise. Of course, the insertion may also be performed in the reverse direction. The boundary rods 240 may be selectively separated from the structure after the manufacturing to the structure is completed.

The three-dimensional lattice truss structure according to the present invention is manufactured by repeating the above-mentioned steps S20 to S50 several times as one cycle according to the desired size of the structure. Such a manufacturing method has a simple process by continuously weaving flexible wires at the same time in the in-plane and out-of-plane directions and is particularly advantageous in mass production.

Figure 15:
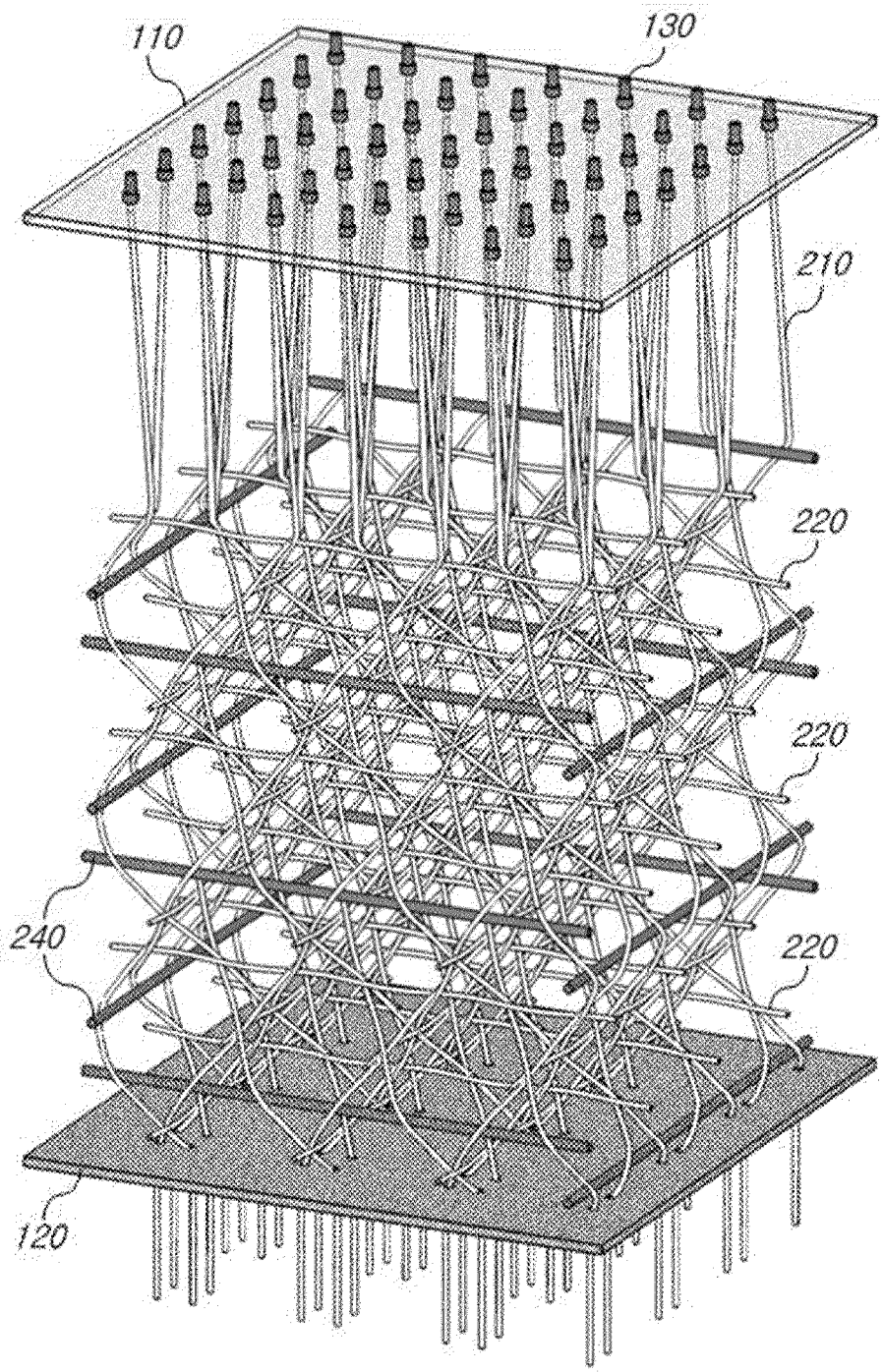
FIG. 15 illustrates a perspective view of a structure similar to a three-dimensional Kagome truss manufactured according to the embodiments of FIGS. 11 to 14.
Figure 16:
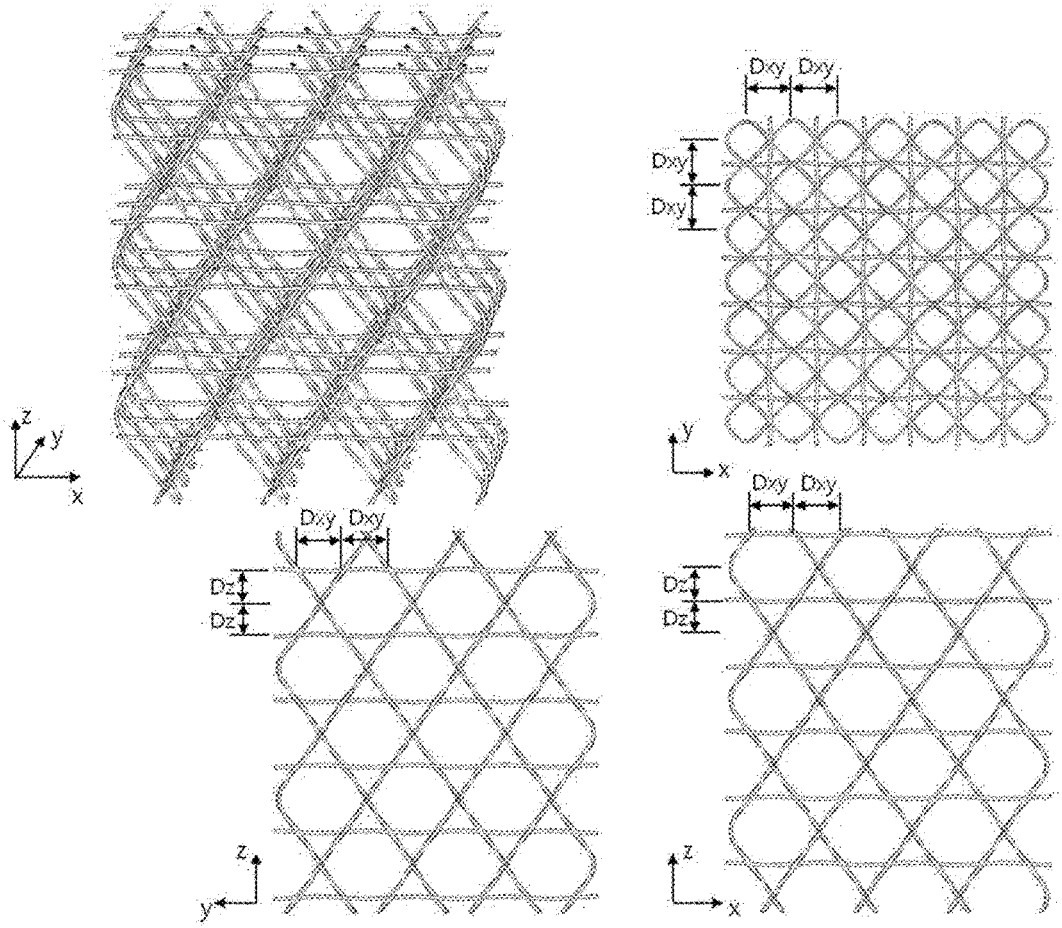
FIG. 16 illustrates a perspective view and a projected figure of a structure similar to a three-dimensional Kagome truss manufactured according to the embodiments of FIGS. 11 to 14.

FIG. 15 illustrates a perspective view of a structure similar to a three-dimensional Kagome truss manufactured according to the embodiment of FIGS. 11 to 14, and illustrates a three-dimensional lattice truss structure manufactured by repeating, three times, the process in which the above-mentioned cycle of steps S20 to S50 are repeated four times. FIG. 16 illustrates a perspective view and a projected figure of a structure similar to the three-dimensional Kagome truss manufactured according to the above-mentioned embodiments of FIGS. 11 to 14, and the structure is illustrated in a state in which remaining wires and boundary rods which are not woven are removed and an upper stage plate 110, a lower stage plate 120, and grips 130 which constitute the weaving apparatus 10 illustrated in FIG. 10 are shown.

As described above, the boundary rods used in the manufacturing process of the three-dimensional lattice truss structure according to the present invention are inserted for the purpose of uniformly guiding the outline of outer surface of the three-dimensional lattice truss structure by preventing the out-of-plane wires from being continuously moved in only one direction. Accordingly, the three-dimensional lattice truss structure according to the present invention, unlike the three-dimensional lattice truss structure of FIG. 4 according to the related art, has a prism shape such as a rectangular parallelepiped and a uniform side surface boundary, thereby having superior design and mechanical strength.

So far, preferable embodiments of the present invention are described in detail with reference to the drawings. The foregoing description of the present invention is considered illustrative, and a person skilled in the art to which the present invention pertains would understand that the present invention could be easily modified into other specific embodiments without change in the technical idea and essential features of the present invention.

For example, in the above embodiments, it is assumed that the number of the out-of-plane wires arranged in the x- and y-directions on the xy plane is an odd number, but the number may be an even number or the combination of odd and even numbers.

Figure 17:
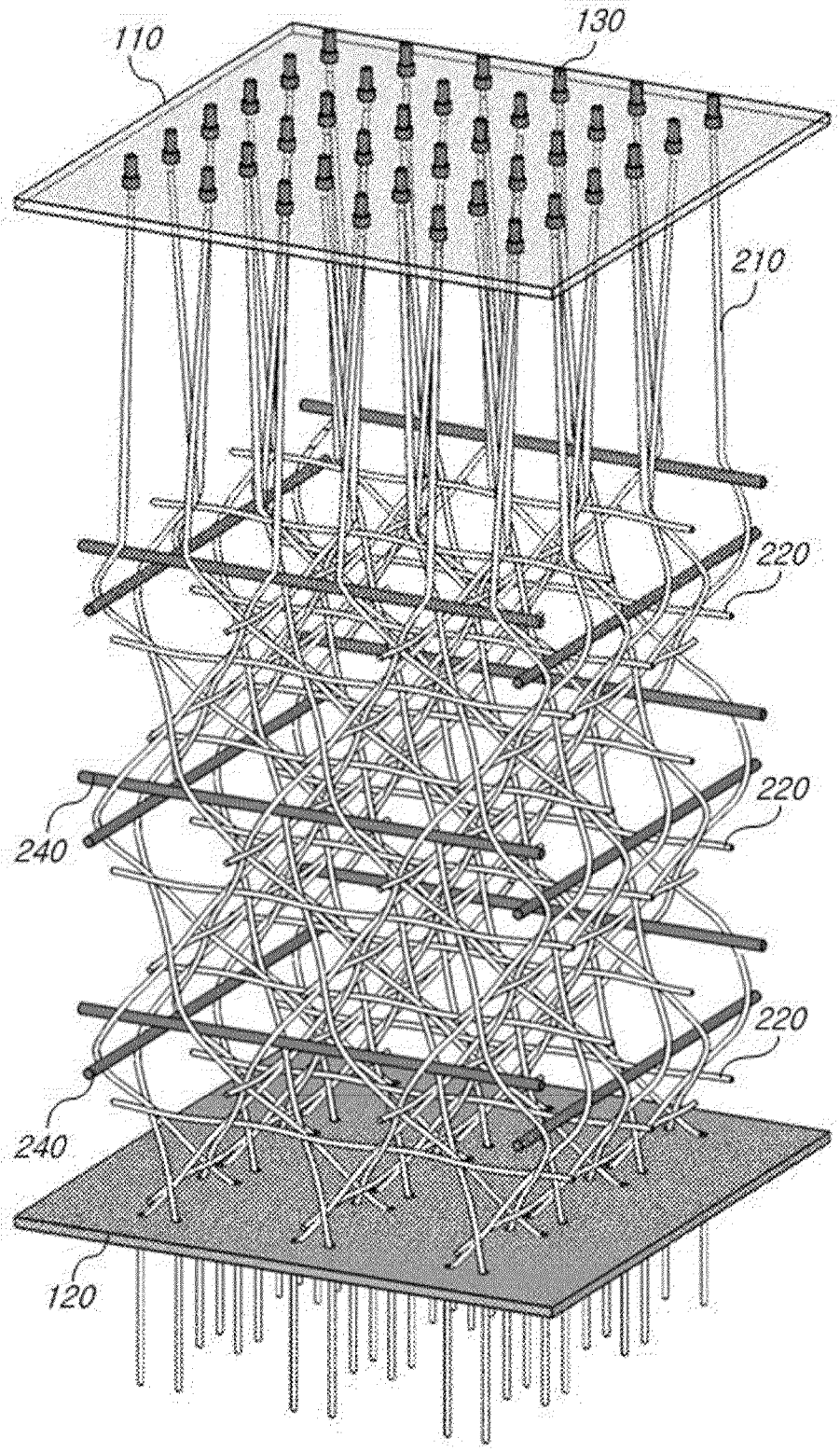
FIG. 17 illustrates a perspective view of a structure similar to a three-dimensional Kagome truss manufactured according to another embodiment of the present invention.
Figure 18:
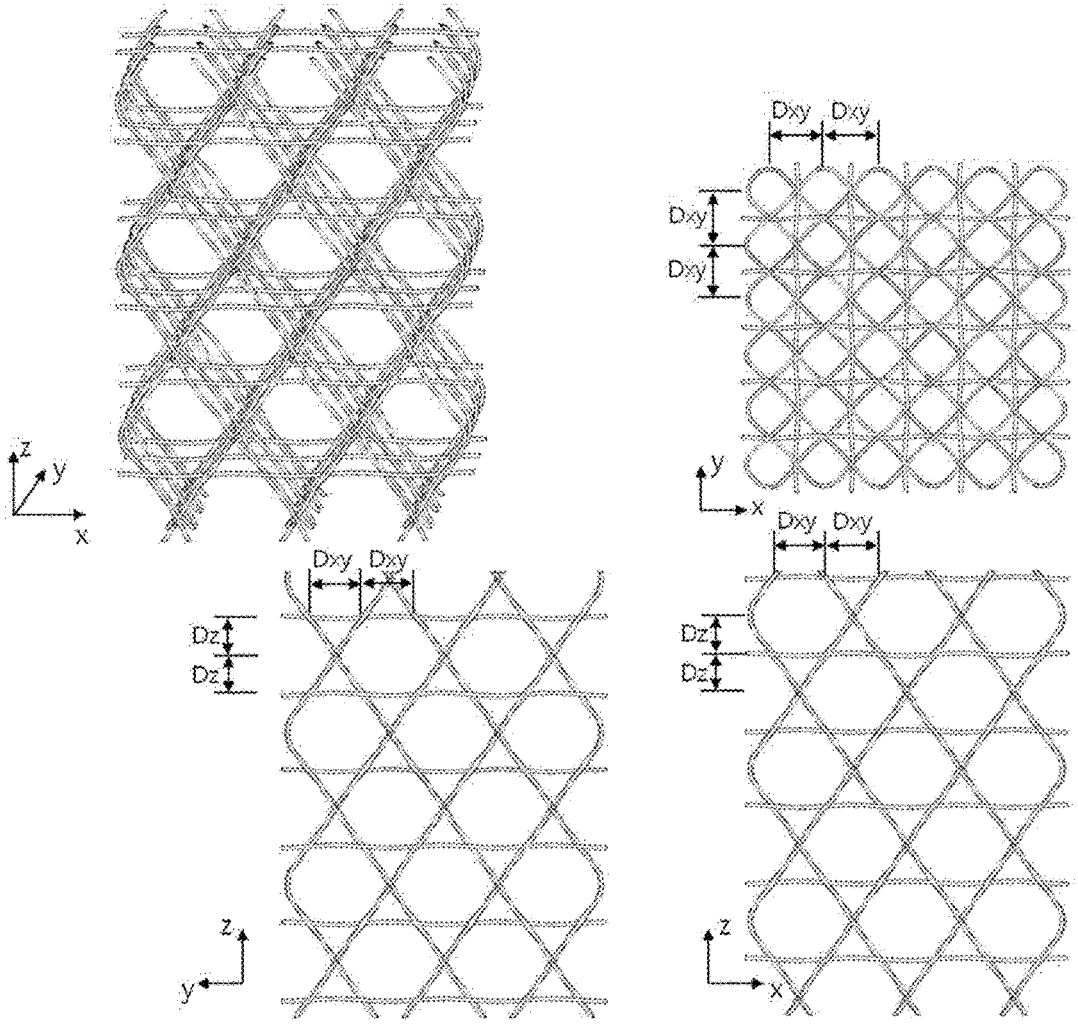
FIG. 18 illustrates a perspective view and a plan view of a structure similar to a three-dimensional Kagome truss manufactured according to the embodiment of FIG. 17.

FIG. 17 illustrates a perspective view of a structure similar to the three-dimensional Kagome truss manufactured according to another embodiment of the present invention, and it is assumed that the number of out-of-plane wires arranged in x- and y-directions on an xy plane is an even number. FIG. 18 illustrates a perspective view and a projected figure of a structure similar to the three-dimensional Kagome truss manufactured according to the embodiment of FIG. 17, and like FIG. 16, the structure is illustrated in a state in which the components of the weaving apparatus illustrated in FIG. 7, and the remaining wires and boundary rods which are not woven are removed. The structures according to the embodiments of FIGS. 17 and 18 are also manufactured by the process according to FIG. 9, but as illustrated in FIG. 17, are different from that in the embodiment of FIG. 15 in that the insertion of boundary rods is performed only in third and fourth cycles. This may be understood such that when the number of out-of-plane wires arranged in x- and y-directions is an even number, an out-of-plane wire group which is not switched in step S20 in each of cycles does not exist in first and second cycles but exists as a pair in outermost sides only in third and fourth cycles, and thus the insertion of boundary rods are also performed selectively only in third and fourth cycles.

Also, in the above embodiments, both ends of the out-of-plane wires are assumed to be arranged to be spaced apart a predetermined interval Dxy from each other in the x- and y-directions on the xy plane, and the out-of-plane wires are thus parallel to each other in the z-direction in a step of starting weaving. However, a different embodiment like that in FIG. 19 is also possible.

Figure 19:
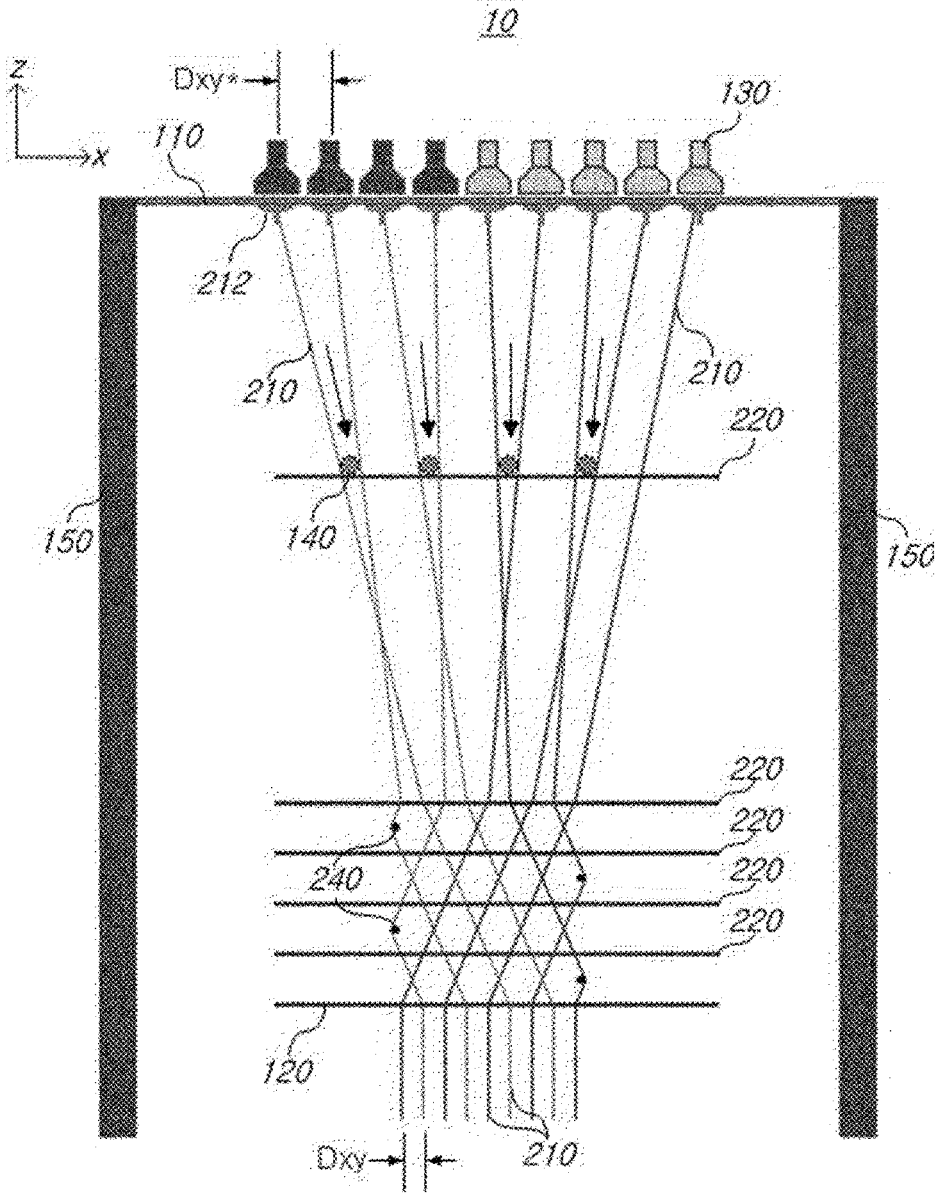
FIG. 19 illustrates a schematic configuration diagram of an apparatus for manufacturing a three-dimensional lattice truss structure according to another embodiment of the present invention.

FIG. 19 illustrates a schematic configuration diagram of an apparatus for manufacturing a three-dimensional lattice truss structure according to another embodiment of the present invention. According to FIG. 19, upper ends of a plurality of out-of-plane wires 210 form free ends movable in x- and y-directions on an xy plane, that is, on an upper surface of an upper plate 110, and lower ends on the opposite side form fixed ends by being spaced apart a predetermined interval Dxy in the x- and y-directions on the xy plane, that is, on a lower surface of a lower plate 120.

In this case, a spaced interval Dxy* of the upper ends of the out-of-plane wires have a relatively greater value than the lower end spaced interval Dxy, and accordingly, unlike the above-mentioned embodiments, the shapes in which the plurality of out-of-plane wires 210 are arranged in the z-direction are not parallel to each other. Also, in the embodiment of FIG. 19, said step S40 is performed such that a plurality of in-plane wires 220 are brought into close contact with each other by being convergently moved downward in the z-direction by using a close contacting rod 140 as illustrated by arrows in the drawing while applying predetermined tensile force to each of the plurality of in-plane wires 220. Accordingly, the spaced interval Dxy of the lower ends of the out-of-plane wires becomes a spaced interval from each other of the out-of-plane wires 210 in the manufactured three-dimensional lattice truss structure.

The smaller the spaced interval Dxy, the finer the structure of the formed three-dimensional lattice truss structure. The three-dimensional lattice truss structure having such a fine structure may be difficult to weave because the distance between the out-of-plane wires is small and the insertion of the in-plane wires is thereby technically difficult. However, in the modified embodiment according to FIG. 19, the spaced interval Dxy* of the upper ends of the out-of-plane wires 210 is made to have a relatively larger value than the lower end spaced interval Dxy, and thus such problems may be effectively solved.

The scope of the present invention is defined not by the detailed description of the invention but by the appended claims, and all modifications and changes induced from the spirit and scope of the present invention and the equivalent concept will be construed as being included in the present invention.

The invention claimed is:

1. A method for manufacturing a three-dimensional lattice truss structure using flexible wires comprising a plurality of out-of-plane wires and a plurality of in-plane wires, the method comprising the steps of:

(a) arranging the plurality of out-of-plane wires each having a free end and a fixed end opposite to the free end, wherein the free end is movable in x- and y-directions on an xy plane, and the fixed end is restrained from moving in the x- and y-directions on the xy plane, wherein fixed ends of the plurality of out-of-plane wires are spaced apart from each other at a predetermined interval (Dxy) in the x- and y-directions on the xy plane;

(b) forming crossing portions between the plurality of out-of-plane wires by switching a first column formed by free ends of the plurality of out-of-plane wires arranged in a y-direction and a second column, adjacent to the first column, formed by free ends of the plurality of out-of-plane wires arranged in the y-direction, in an x-direction on the xy plane;

(c) shifting a first row formed by free ends of the plurality of out-of-plane wires arranged in the x-direction and a second row, adjacent to the first row, formed by free ends of the plurality of out-of-plane wires arranged in the x-direction, to a distance respectively, in opposite directions in the x-direction, and then inserting the plurality of in-plane wires in the y-direction above the crossing portions;

(d) shifting the first and second rows back to the distance respectively, in opposite directions in the x-direction such that the first and second rows are returned to positions before the shifting in the step (c), and then translating the plurality of in-plane wires in a z-direction such that the crossing portions are moved in the z-direction together with the plurality of in-plane wires; and (e) inserting a boundary rod in the y-direction between an outmost column, in the y-direction, of free ends of the out-of-plane wires which is not woven with the plurality of in-plane wires and an adjacent column, in the y-direction, of free ends of the out-of-plane being woven with the plurality of in-plane wires, wherein orientations are defined on a basis of an x, y and z orthogonal coordinates system, the steps (b) to (e) is sequentially performed, and the plurality of in-plane wires are arranged in the z-direction to be spaced apart from each other at a predetermined interval (Dz).

2. The method for manufacturing a three-dimensional lattice truss structure of claim 1, further comprising:

(f) switching the x- and y-directions on the xy plane after the step (e); and (g) repeating a cycle of the steps (b) to (f).

3. The method for manufacturing a three-dimensional lattice truss structure of claim 2, wherein the switching in the step (b) is performed by a unit group comprising two cycles such that: the switching in the step (b) is performed from an outermost out-of-plane wires in a first cycle group and is performed from out-of-plane wires excluding the outermost out-of-plane wires in a second cycle group, and the first and second cycle groups are alternately performed.

4. The method for manufacturing a three-dimensional lattice truss structure of claim 1, wherein an interval (Dz) at which the plurality of in-plane wires are spaced apart from each other in the z-direction is approximately $\sqrt{2}/2$ times the interval (Dxy) at which the plurality of out-of-plane wires are spaced apart from each other in the x- and y-directions on the xy plane.

5. The method for manufacturing a three-dimensional lattice truss structure of claim 1, wherein in said step (a), the plurality of out-of-plane wires are arranged in parallel in the z-direction.

6. The method for manufacturing a three-dimensional lattice truss structure of claim 1, wherein in said step (a), a spaced interval at the free ends of the plurality of out-of-plane wires is greater than the spaced interval (Dxy) at fixed ends of the out-of-plane wires.

* * * * *